United States Patent [19]

Bradford

[11] Patent Number: 4,691,358

[45] Date of Patent: Sep. 1, 1987

[54] STEREO IMAGE DISPLAY DEVICE

[76] Inventor: John R. Bradford, c/o B&B Systems, 28111 N. Ave. Stanford, Valencia, Calif. 91355

[21] Appl. No.: 851,855

[22] Filed: Apr. 14, 1986

[51] Int. Cl.[4] ..... H04H 5/00

[52] U.S. Cl. ..... 381/12; 324/88; 324/121 R; 340/722; 328/133

[58] Field of Search ..... 324/121 R, 88; 340/722, 340/754; 358/10, 144; 328/133, 158, 159; 381/1, 12

[56] References Cited

U.S. PATENT DOCUMENTS 2,467,361 4/1949 Blewett ..... 324/88

2,931,902 4/1960 Boekhorst ..... 328/158

OTHER PUBLICATIONS

Ex Parte S, JPOS, 1943, vol. XXV, No. 12, pp. 904–905.

*Primary Examiner*—Forester W. Isen

*Attorney, Agent, or Firm*—Nilsson, Robbins, Dalgarn, Berliner, Carson & Wurst

[57] ABSTRACT

An apparatus is disclosed which provides a display of the stereo image and aural perspective of stereophonic sounds. Left and right signal are processed to form rectified sum and difference signals which are applied to the signals which are applied to the vertical and horizontal deflection electrodes of an oscilloscope.

6 Claims, 8 Drawing Figures

FIG. 1
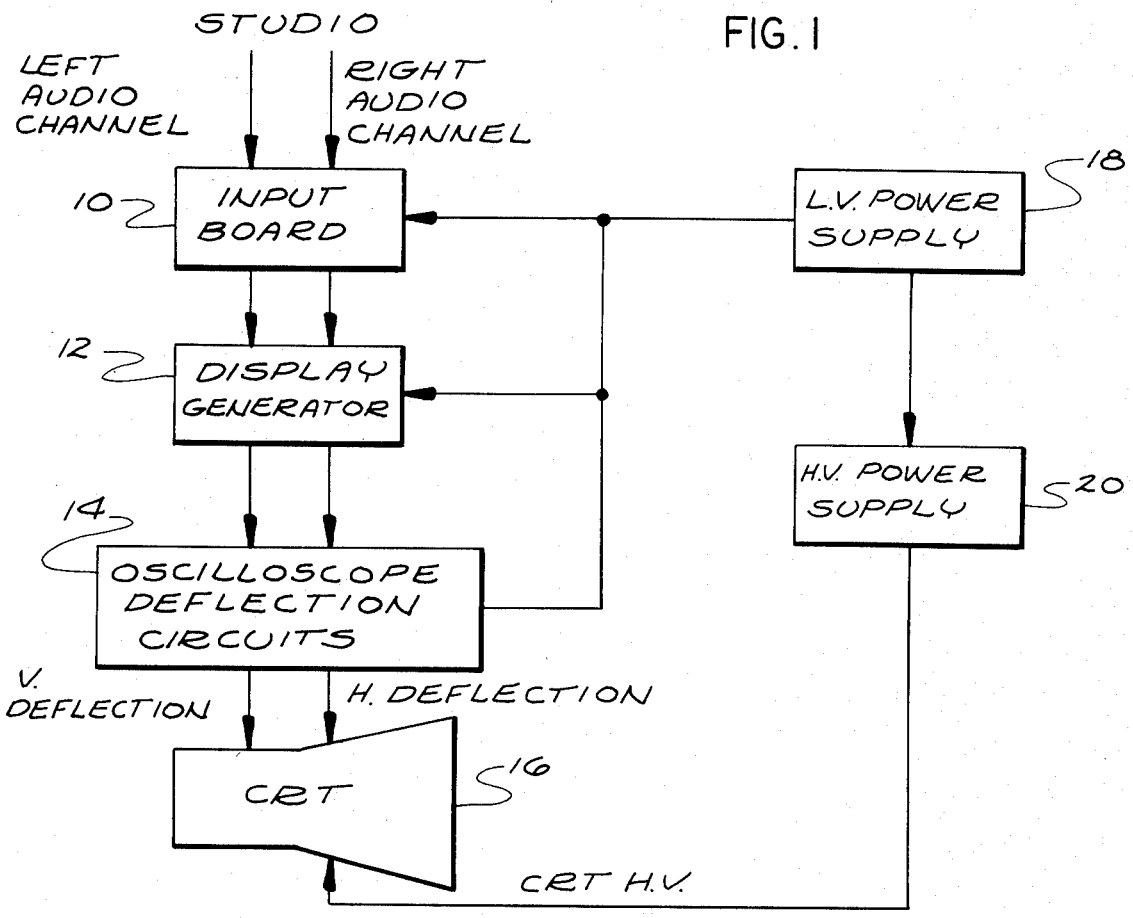
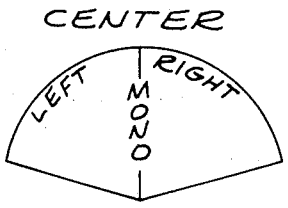
FIG. 3A
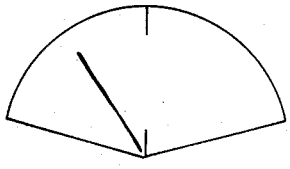
FIG. 3B
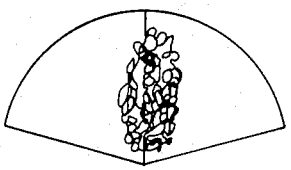
FIG. 3C
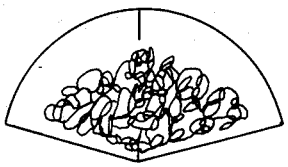
FIG. 3D
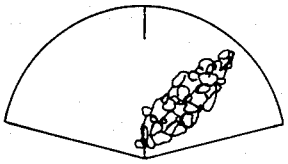
FIG. 3E
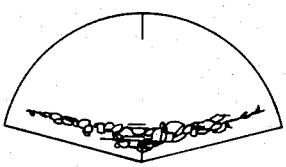
FIG. 3F

STEREO IMAGE DISPLAY DEVICE

BACKGROUND OF THE INVENTION

This invention relates to stereophonic sound systems and more particularly to equipment for analyzing the properties of sounds generated in multichannel sound systems.

When sound is recorded, transmitted or played using multichannel systems it is important to present the listener with as perfect a reproduction as possible of the original sound including the direction from which the sound may be perceived. A person listening to a sound source may sense variations in the relative loudness and phase of the sound received in his left and right ears. This loudness and phase information is combined in the mind of the listener to determine the "aural perspective" of the sound which may include not only the principal direction from which the sound appears to be emanating (its balance) but also the range of directions from which all parts of the sound appear to be coming (its separation) and the loudness of the individual parts of the sound over that range (its modulation). In order to maintain reproduction quality, sound engineers generally strive to maintain the loudness and phase of multichannel sound, which may be generally referred to as the "stereo image" of the sound, as close to original values as possible, although in select cases, they may attempt to manipulate the stereo image of the sound to produce certain special effects. In any event, reliable information about the stereo image and aural perspective of sound represented by multichannel sound signals (which regardless of the number of channels is generally referred to as "stereophonic sound") is necessary in order to make decisions about how to regulate the sound.

In the past, audio engineers have frequently used their own ears to determine the aural perspective of stereophonic sound. However, this requires a listening system of known calibration such as a specially designed audio room and is very difficult and time consuming work. Alternatively, audio engineers have used laboratory oscilloscopes electrically driven so that one channel of a stereophonic system is used to control the vertical deflection and another channel is used to control the horizontal deflection of the electron beam on the screen of the oscilloscope. These so-called "X.Y configuration" displays provide only limited amounts of information about the stereo images of the sounds by displaying arbitrary types of signals which suggest errors in the stereo image. X.Y configuration displays do not give the user any useful indication as to the details of the actual aural perspective of the sound.

The present invention provides a display which provides accurate and reliable information about the stereo image and aural perspective of stereophonic sound. The display includes signals which illustrate directly to the user the aural perspective of the sound including its modulation, separation and balance.

Further, the invention may be used to view and adjust the stereo image of the intended constituents of a composite sound on the individual channels of a multichannel recording system before each constituant is mixed into the composite to form the desired complex sound recording. Stereophonic sound may thereby be mixed without the need for a calibrated listening room.

Additionally, the present invention provides a display which quickly and positively indicates when stereophonic sound signals are completely out of phase and therefore incompatible for monoaural playback as may occur if one of the signals becomes electrically inverted.

SUMMARY OF THE INVENTION

The present invention constitutes a system and method for providing a display indicative of the aural perspective of two stereophonic sound signals from a multichannel sound system. The system comprises a set of converters and amplifiers for separately conditioning two stereophonic input signals to required input parameters, a plurality of rectifiers for producing dc outputs, two summing networks for combining signals, and an inverting amplifier.

In operation, a first output signal is produced by feeding the two adjusted stereophonic signals to a summing network and rectifying the output of the summing network. A second output signal is produced by rectifying the two adjusted stereophonic signals, passing one of the rectified signals through an inverting amplifier and feeding the inverted signal and the stereophonic signal which was not inverted into a second summing network. The resulting first and second output signals are used as inputs to an oscilloscope for generating the desired display.

The display on the screen of the oscilloscope comprises either a line extending radially outward from a centrally located fixed point or a pattern of continuous, irregularly curved lines which extends radially outward from a centrally located fixed point. The radial length of the line or pattern indicates modulation, the breadth of the pattern indicates separation, and the angular displacement of the line or pattern from a centerline indicates balance.

BRIEF DESCRIPTION OF THE DRAWINGS

FIG. 1 is a block diagram of the electrical board modules comprising the present invention.

FIGS. 3A, B, C, D, E and F are diagrams of displays generated in accordance with the present invention.

DESCRIPTION OF THE PREFERRED EMBODIMENT

Figure 2:
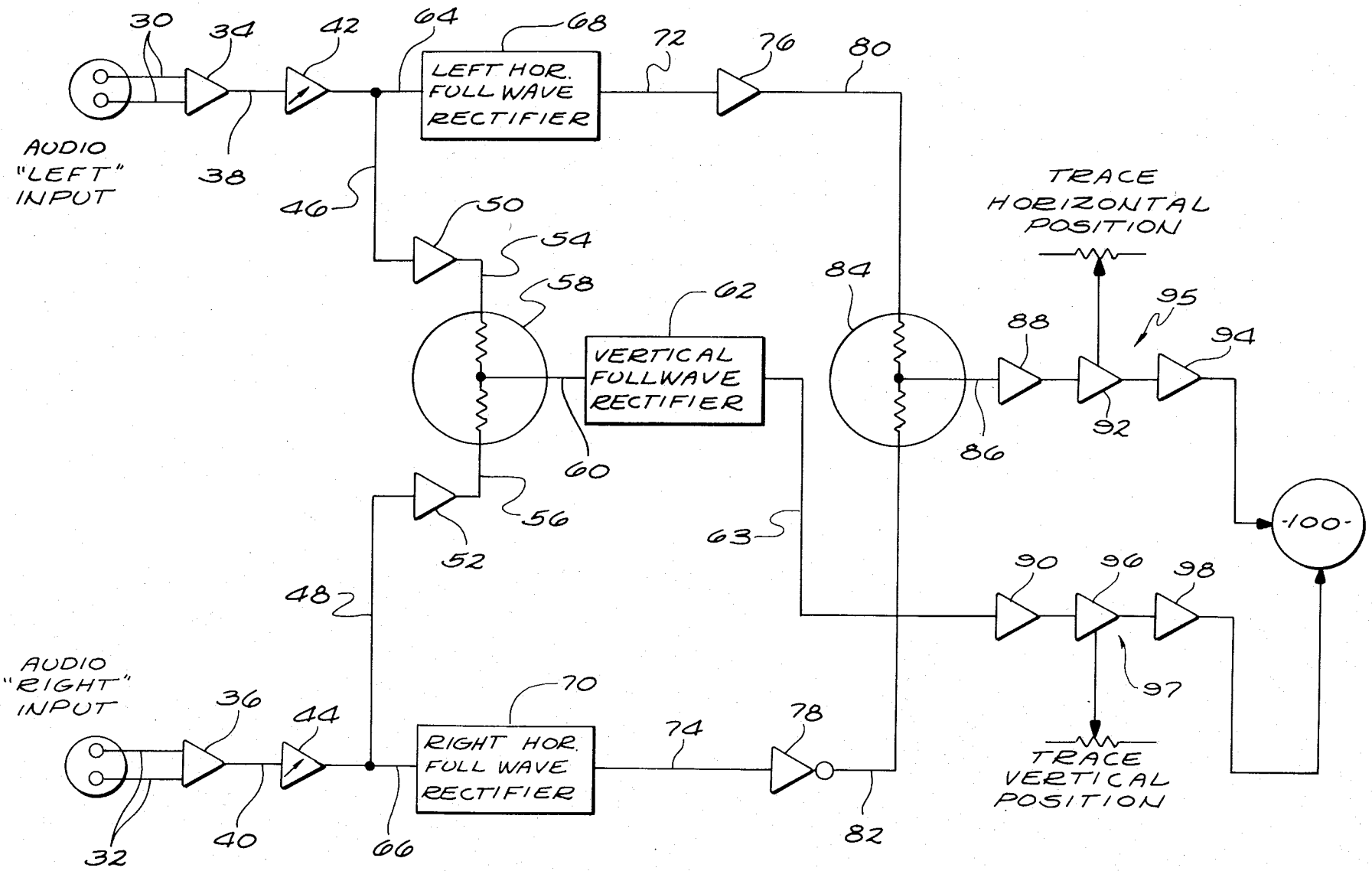
FIG. 2 is a block diagram of the basic components comprising the present invention.

Referring now to FIG. 1 the present invention includes an input board 10 for separately conditioning two stereophonic sound signals representing different sound channels from an outside source of multichannel signals such as a sound studio or a magnetic tape recording machine. The input board 10 adjusts these signals to the desired input formats and input levels. The display board 12 receives the conditioned signals from the input board 10 and processes those signals to produce two completely new output signals. These new signals are fed to an oscilloscope deflection circuit module 14 of conventional design for applying the signals to effect the vertical and horizontal displacement of an electron beam on the screen of a cathode ray tube 16. A low voltage power source 18 is provided to supply electrical power to the boards 10, 12 and 14 and a high voltage power supply 20. The high voltage power supply 20 provides appropriate high voltage electrical power required for the operation of the cathode ray tube 16. The above described board modules cooperate to produce a unique and useful display of the stereo image and aural perspective of the stereophonic signals received from an outside source on the screen of the cathode ray tube 16.

Referring now to FIG. 2 the actual electrical components of the present invention are illustrated. Two balanced multichannel sound signals (hereinafter referred to as the right and left channel signals) whose stereo image with respect to each other is desired to be monitored are supplied along the lines 30 and 32 to the balanced to unbalanced converters 34 and 36. The converters 34 and 36 modify the signals from a balanced (two conductor) to an unbalanced (one conductor) format in which the signals reference a single ground potential. The converters 34 and 36 are high impedance, differential amplifiers of conventional design. The right and left unbalanced signals are separately fed along the lines 38 and 40 to the amplifiers 42 and 44 which adjust the signals to nominal circuit levels required for further processing. The amplifiers 42 and 44 are variable gain amplifiers of conventional design suitable for adjusting signal strengths from elevated voltage levels such as studio line levels. The right and left unbalanced and adjusted signals are supplied along the lines 46 and 48 to the impedance converters 50 and 52 which operate to isolate the left and right channel lines 46 and 48 with respect to the summing network 58. The converters 50 and 52 are high input impedance, low output impedance buffer amplifiers of standard design.

The output signals from the converters 50 and 52 are directed along the lines 54 and 56 to the summing network 58 which combines the left and right signals to produce a combined output signal which represents a sum of these signals. The summing network 58 is a conventional resistive network for equally combining two signals. The combined signal is supplied along line 60 to the full wave rectifier 62. The rectifier 62 is an active, precision rectifier for processing an audio waveform into a pulsating dc output. The output of the rectifier on line 63 represents a rectified and combined right and left channel signal sum.

The unbalanced and adjusted right and left signals from the amplifiers 42 and 44 are also directed along the lines 64 and 66 to the full wave rectifiers 68 and 70. The rectifiers 68 and 70 are active, precision rectifiers for processing audio waveforms into a pulsating dc outputs. The right and left signals from the rectifiers 68 and 70 are fed along lines 72 and 74 to the impedance converters 76 and 78 which operate to isolate the left and right channel lines 72 and 74 with respect to the summing network 84. The converters 76 and 78 are high input impedance, low output impedance buffer amplifiers of standard design. However, the converter 78 is also an inverting amplifier which operates to electrically invert the output of the rectifier 70. The output signals from the converters 76 and 78 are directed along the lines 80 and 82 to the summing network 84 which combines the right signal with the left (inverted) signal. The summing network 84 is a conventional resistive network for equally combining two signals. The output of the summing network 84 on line 86 represents a rectified and combined right and left channel signal difference.

The output signals from the rectifier 62 and the summing network 84 are supplied along the lines 63 and 86 to standard buffer amplifiers 88 and 90 for interfacing with oscilloscope deflection circuits. The output signal from the amplifier 88 representing the combined right and left signal sum is directed to the amplifiers 92 and 94 which comprise conventional horizontal deflection control circuits 95 for an oscilloscope. The output signal from the amplifier 90 representing the combined right and left signal difference is directed to the amplifiers 96 and 98 which comprise conventional vertical deflection control circuits 97 for an oscilloscope. The control circuits 95 and 97 are connected to a conventional cathode ray tube 100 having a screen for providing a display.

When the output signals from the amplifiers 88 and 90 are fed to the deflection circuits 95 and 97 a unique and useful display is traced out on the screen of the cathode ray tube 100 by the electron beam of the tube. The display comprises either a single line or a pattern including a large number of continuous and irregularly curved lines extending out radially from a centrally located fixed point on the oscilloscope screen. The position and orientation of the line or the pattern of curved lines indicate the characteristics of the aural perspective of the sounds which would be generated by the signals in a conventional stereophonic listening system such as a "stereo hi-fi". The radial distance which the radial line or radial pattern of curved lines extends from the centrally located point on the display indicates input signal modulation. The direction and degree of angular displacement of the radial line or pattern of curved lines from the vertical center line of the display indicates input signal balance including both the direction and degree to which sounds may be perceived to be emanating from either right or left of center. The radial breadth of a pattern of curved lines indicates the input signal separation.

Referring now to FIGS. 3A through 3F, six examples of stereo image and aural perspective displays are shown. FIG. 3A illustrates the screen of the cathode ray tube 100 with certain interpretive legends and without any display output being shown. FIG. 3B illustrates a display indicating a single tone input panned mid-left at 80% modulation. FIG. 3C illustrates a display indicating a stereo program input with narrow separation and good balance at 80% modulation. FIG. 3D illustrates a display indicating a stereo program input with good separation and good balance at 65% modulation. FIG. 3E illustrates a display indicating a stereo program with narrow separation, heavy right balance at 90% modulation. FIG. 3F illustrates a display indicating a stereo program input with extreme separation and center cancellation resulting from completely out of phase input signals.

While the system of this invention has been described in conjunction with particular embodiments, it should be apparent that certain changes could be made without departing from the principles of the invention. For example, the major components of the present invention could be replaced by electronic digital devices performing the same basic functions and the resulting device could then be used to monitor digital stereophonic signals. Consequently, the embodiments provided are intended to be illustrative only and are not meant to limit the scope of the following claims.

I claim:

1. A device for providing a display on a cathode ray tube indicative of the stereo image and aural perspective of a first stereophonic signal and a second stereophonic signal from different channels of a multichannel stereophonic system, comprising:

first means for processing said first and said second stereophonic signals to produce a rectified sum output, said processing means including a summing network and a rectifier;

second means for processing said first and said second stereophonic signals to produce a rectified difference output, said means including a plurality of rectifiers, an inverting amplifier and a summing network;

oscilloscope display means having a cathode ray tube with a display screen and having first deflection control circuits connected to said first processing means for receiving said rectified sum output and having second deflection control circuits connected to said second processing means for receiving said rectified difference output.

2. The device of claim 1 further including a plurality of impedance converters for electrically isolating said summing networks from their input signal sources.

3. A device for providing a display on a cathode ray tube indicative of the stereo image and aural perspective of a first balanced stereophonic signal and a second balanced stereophonic signal for different channels of a multichannel stereophonic system, comprising:

conditioning means connected to said stereophonic system for unbalancing and amplifying said stereophonic signals to produce a first adjusted stereophonic signal and a second adjusted stereophonic signal;

a first summing network means connected to said conditioning means for combining said first and second adjusted stereophonic signals to form a combined sum output;

a first rectifier means connected to said summing network means for rectifying said combined output and producing a rectified sum output;

a second rectifier means connected to said conditioning means for rectifying said first adjusted stereophonic signal and producing a first rectified stereophonic signal;

a third rectifier means connected to said conditioning means for rectifying said second stereophonic signal and producing a second rectified sterophonic signal;

inverting means connected to said third rectifier means for inverting said second rectified stereophonic signal and producing an inverted stereophonic signal;

a second summing network means connected to said second rectifier means and said inverting means for combining said second rectified stereophonic signal and said inverted stereophonic signal to form a rectified difference output;

oscilloscope means having a cathode ray tube with a display screen and having vertical deflection control circuits connected to said first rectifier means for receiving said rectified sum output and having horizontal deflection control circuits connected to said second summing network for receiving said rectified difference output.

4. A method of producing a display indicative of the stereo image and aural perspective of first and second balanced stereophonic signals from two channels of a multichannel stereophoenic system on an oscilloscope having vertical and horizontal deflection circuits, comprising the steps of:

unbalancing and amplifying said first and second stereophonic signals to provide adjusted first and second stereophonic signals;

combining said first and second adjusted stereophonic signals to form a combined sum output;

rectifying said combined sum output to form a rectified sum output;

separately rectifying said first and said second adjusted stereophonic signals to produce first and second rectified stereophonic signals;

inverting said second rectified stereophonic signal to produce an inverted stereophonic signal;

combining said first rectified stereophonic signal and said inverted stereophonic signal to form a rectified difference output;

feeding said rectified sum output to said vertical control circuits and said rectified difference output to said horizontal control circuits.

5. The method of claim 4, further including the steps of: isolating said combining steps from prior steps by passing the input signals intended to be combined through impedance converters having high input impedance and low output impedance.

6. A display appearing on the screen of an oscilloscope means which is indicative of the stereo image and aural perspective of first and second stereophonic signals from different channels of a multichannel stereophonic system, said display comprising a plurality of continuous, irregularly curved lines which form a pattern extending radially outward from a centrally located fixed point, wherein the radial length of said pattern indicates modulation, the breadth of said pattern indicates separation, and the angular displacement of said pattern from a centerline on said screen indicates balance, said display produced by a method comprising the steps of:

generating a rectified sum output by combining and rectifying said stereophonic signals;

generating a rectified difference output by rectifying said stereophonic signals, inverting one of said rectified stereophonic signals to produce an inverted signal and combining said inverted signal with the rectified stereophonic signal which was not inverted;

feeding said rectified sum and rectified difference outputs to said oscilloscope means.

* * * * *